US007540928B2

(12) United States Patent
Marsal et al.

(10) Patent No.: US 7,540,928 B2
(45) Date of Patent: Jun. 2, 2009

(54) PROCESS FOR MANUFACTURING BAKE HARDENING STEEL SHEET, AND STEEL SHEET AND PARTS THUS OBTAINED

(75) Inventors: Joël Marsal, Beyren-les-Sierck (FR); Fernande Kirch, Ay sur Moselle (FR); Dominique Mescolini, Metz (FR)

(73) Assignee: Usinor, Puteaux (FR)

( * ) Notice: Subject to any disclaimer, the term of this patent is extended or adjusted under 35 U.S.C. 154(b) by 393 days.

(21) Appl. No.: 10/531,264

(22) PCT Filed: Oct. 10, 2003

(86) PCT No.: PCT/FR03/02985

§ 371 (c)(1), (2), (4) Date: Feb. 17, 2006

(87) PCT Pub. No.: WO2004/035838

PCT Pub. Date: Apr. 29, 2004

(65) Prior Publication Data

US 2006/0157166 A1 Jul. 20, 2006

(30) Foreign Application Priority Data

Oct. 14, 2002 (FR) ..... 02 12753

(51) Int. Cl.
*C22C 38/04* (2006.01)
*C22C 38/06* (2006.01)
*C21D 8/02* (2006.01)

(52) U.S. Cl. ..... 148/330; 148/320; 148/603; 148/651; 148/652

(58) Field of Classification Search ..... 148/320, 148/330, 603, 651, 537; 420/121
See application file for complete search history.

(56) References Cited

U.S. PATENT DOCUMENTS 4,853,032 A * 8/1989 Yalamanchili et al. ..... 75/10.49
5,919,415 A * 7/1999 Pichard ..... 420/106
6,027,581 A * 2/2000 Osawa et al. ..... 148/330
6,162,308 A 12/2000 Heidtmann et al.
6,171,413 B1 * 1/2001 Funakawa et al. ..... 148/330

FOREIGN PATENT DOCUMENTS

| | | | |
|---|---|---|---|
| DE | 197 01 443 A | | 7/1998 |
| EP | 870848 A | | 10/1998 |
| EP | 905267 A | | 3/1999 |
| JP | 57-143435 | * | 9/1982 |
| JP | 2002-12920 | * | 1/2002 |
| WO | WO 02/059384 A | | 8/2002 |

OTHER PUBLICATIONS

International Search Report for PCT/FR03/002985 dated Mar. 24, 2004.

* cited by examiner

*Primary Examiner*—Deborah Yee
(74) *Attorney, Agent, or Firm*—Sughrue Mion, PLLC

(57) ABSTRACT

The invention concerns a method for making hardenable steel plates by firing comprising: preparing a steel whereof the composition comprises, expressed in weight percent: 0.03=C=0.06, 0.50=Mn=1.10, 0.08:=Si=0.20, 0.015=Al=0.070, N=0.007, Ni=0.040, Cu=0.040, P=0.035, S=0.015, Mo=0.010, Ti=0.005; provided that it comprises boron in an amount such that 0.64=B/N=1.60 the rest consisting of iron and impurities resulting from production; casting a slab of said steel, then hot rolling of said slab to obtain a plate, the final rolling temperature being higher than the point Ar3; winding said plate at a temperature ranging between 500 and 700° C.; then cold rolling of said plate at a reduction rate ranging between 50 and 80%; continuous annealing heat treatment for a time interval less than 15 minutes; and strain hardening with a reduction rate ranging between 1.25 and 2.5%. The invention also concerns the hardenable plates and the parts obtainable therefrom.

9 Claims, No Drawings

PROCESS FOR MANUFACTURING BAKE HARDENING STEEL SHEET, AND STEEL SHEET AND PARTS THUS OBTAINED

The present invention relates to a process for manufacturing bake hardening steel sheet as well as to steel sheet and parts obtained by implementing this process.

This steel sheet and these steel parts may include an anticorrosion coating, such as that obtained by hot dip galvanizing or by electrogalvanizing. The steel sheet is more particularly intended for the manufacture of visible parts for automobiles, such as hoods for example, whereas the parts, which are thicker than the sheet, are more particularly intended for the production of structural parts, again for automobiles.

This is because visible parts for automobiles must be produced from a material which can be processed easily by drawing and has, on completion of this processing operation, good indentation resistance and is as light as possible so as to reduce vehicle consumption.

Now, these various characteristics are contradictory—a material has good drawability when its yield strength is low, but good indentation resistance requires it to have a high yield strength and to be of great thickness.

Bake hardening (BH) steels have therefore been developed that are characterized by a low yield strength before forming, so that they are easily drawable. However, once drawn, then coated with paint and subjected to a bake heat treatment (at 170° C. for 20 minutes), it is found that BH steel sheet or parts have a yield strength that has increased considerably, giving them good indentation resistance.

In the case of structural parts, this property of hardening as the coating is being baked is in particular put to advantage in order to reduce the thickness, and therefore the weight, of these parts.

From a metallurgical standpoint, these property modifications can be explained by the behavior of the carbon in solid solution in the steel. This carbon has a natural tendency of being fixed on the dislocations in the steel, until they are saturated, thereby hardening the steel. By controlling the amount of carbon in solid solution and the density of dislocations present in the steel during the process, it is therefore possible to harden the steel when so desired, by creating new dislocations that are saturated with carbon, which remains in solid solution and which migrates under the effect of thermal activation. However, the presence of too large a quantity of carbon in solid solution should be avoided, as it could then cause aging of the steel in the form of inopportune hardening before drawing, which would go counter to the intended aim.

Bake hardening steels are known, the composition of which includes manganese and silicon and an appreciable amount of phosphorus, in the region of 0.1% by weight. These steels have good mechanical properties and a bake hardening (BH) value, i.e. an increase in yield strength after baking, of about 45 MPa, but they undergo considerable natural aging.

The object of the present invention is to provide bake hardening steels having good mechanical properties, which have a bake hardening (BH) value of at least 40 MPa and are less sensitive to natural aging than the steels of the prior art.

For this purpose, a first subject of the present invention is a process for manufacturing bake hardening steel sheet comprising:

the smelting of a steel, the composition of which comprises, expressed in % by weight:

$0.03 \leqq C \leqq 0.06$
$0.50 \leqq Mn \leqq 1.10$
$0.08 \leqq Si \leqq 0.20$ $0.015 \leqq Al \leqq 0.070$
$N \leqq 0.007$
$Ni \leqq 0.040$
$Cu \leqq 0.040$
$P \leqq 0.035$
$S \leqq 0.015$
$Mo \leqq 0.010$
$Ti \leqq 0.005$ it being understood that the steel also contains boron in an amount such that:

$$0.64 \leq \frac{B}{N} \leq 1.60$$

the balance of the composition consisting of iron and impurities resulting from the smelting;

the casting of a slab of this steel, this slab then being hot rolled in order to obtain a sheet, the end-of-rolling temperature being above that of the Ar3 point;

the coiling of said sheet at a temperature of between 500 and 700° C.; then the cold rolling of said sheet with a reduction ratio of 50 to 80%;

a continuous annealing heat treatment which is carried out for a time of less than 15 minutes; and a skin pass which is carried out with a reduction ratio of between 1.2 and 2.5%.

In a first preferred method of implementation, the continuous annealing heat treatment comprises:

a reheat of the steel until it reaches a temperature of between 750 and 850° C.;

an isothermal soak;

a first cooling operation down to a temperature of between 380 and 500° C.; and an isothermal soak; and then a second cooling operation down to the ambient temperature.

In a second preferred method of implementation, first cooling operation comprises a slow first part carried out at a rate of less than 10° C./s, followed by a rapid second part carried out at a rate of between 20 and 50° C./s.

The process may also comprise the following variants, taken individually or in combination:

the manganese content and the silicon content of the steel are such that:

$$4 \leq \frac{\%\ Mn}{\%\ Si} \leq 15;$$

the manganese content of the steel is between 0.55 and 0.65% by weight and the silicon content of the steel is between 0.08 and 0.12% by weight;

the manganese content of the steel is between 0.95 and 1.05% by weight and the silicon content of the steel is between 0.16 and 0.20% by weight;

the nitrogen content of the steel is less than 0.005% by weight; and the phosphorus content of the steel is less than 0.015% by weight.

The carbon content of the composition according to the invention is between 0.03 and 0.06% by weight, as this element substantially lowers the ductility. However, it must have a minimum content of 0.03% by weight in order to avoid any aging problem.

The manganese content of the composition according to the invention must be between 0.50 and 1.10% by weight. Manganese improves the yield strength of the steel while greatly reducing its ductility. Below 0.50% by weight, aging problems are observed, whereas above 1.10% by weight the ductility is reduced excessively.

The silicon content of the composition according to the invention must be between 0.08 and 0.20% by weight. Silicon greatly improves the yield strength of the steel, while slightly reducing its ductility, but it substantially increases its aging tendency. If its content is below 0.08% by weight, the steel does not have good mechanical properties, whereas if it exceeds 0.20% by weight surface appearance problems arise, striping defects appearing on the surface.

In a preferred embodiment of the invention, the ratio of the manganese content to the silicon content is between 4 and 15 so as to avoid any problem of embrittlement in flash welding. This is because, if the ratio lies outside these values, the formation of embrittling oxides is observed during this welding operation.

The main function of the boron is to fix the nitrogen by early precipitation of boron nitrides. It must therefore be present in a sufficient amount to prevent an excessive amount of nitrogen remaining free, without however too greatly exceeding the stoichiometric quantity, since the free residual amount could pose metallurgical problems and cause coloration of the edges of the coil. For information, it should be mentioned that strict stoichiometry is achieved for a B/N ratio of 0.77.

The aluminum content of the composition according to the invention is between 0.015 and 0.070% by weight, without this being of critical importance. The aluminum is present in the grade according to the invention owing to the smelting process during which this element is added in order to deoxidize the steel. However, the content must not exceed 0.070% by weight as problems of aluminum oxide inclusions would then be encountered, these being deleterious to the mechanical properties of the steel.

Phosphorus is limited in the steel according to the invention to a content of less than 0.035% by weight, preferably less than 0.015% by weight. Phosphorus allows the yield strength of the grade to be increased, but at the same time it increases its aging tendency in the heat treatments, which explains it limitation. It also impairs the ductility.

The titanium content of the composition must be less than 0.005% by weight, the sulfur content must be less than 0.015% by weight, the nickel content must be less than 0.040% by weight, the copper content must be less than 0.040% by weight and the molybdenum content must be less than 0.010% by weight. These various elements constitute in fact the residual elements resulting from the smelting of the grades that are usually encountered. Their contents are limited as they are capable of forming inclusions that reduce the mechanical properties of the grade. Among these residual elements may also be niobium, which is not added to the composition but may be present in trace amounts, that is to say with a content of less than 0.004%, preferably less than 0.001%, and particularly preferably equal to 0.

A second subject of the invention is a bake hardening sheet that can be obtained by the process according to the invention and that has a yield strength of between 260 and 360 MPa, a tensile strength of between 320 and 460 MPa, a BH2 value of greater than 40 MPa, and preferably greater than 60 MPa, and a yield plateau of less than or equal to 0.2%.

The present invention will be illustrated by the following examples, the table below giving the composition of the various steels tested, in % by weight, among which heats 1 to 4 are in accordance with the present invention, while heat 5 is used as comparison.

| | Heat 1 | Heat 2 | Heat 3 | Heat 4 | Heat 5 |
|---|---|---|---|---|---|
| C | 0.044 | 0.045 | 0.038 | 0.043 | 0.066 |
| Mn | 0.546 | 0.989 | 0.598 | 1.000 | 0.625 |
| Si | 0.089 | 0.167 | 0.088 | 0.179 | 0.091 |
| N | 0.0033 | 0.0042 | 0.0032 | 0.0045 | 0.0039 |
| B | 0.0025 | 0.0029 | 0.0051 | 0.0029 | — |
| Al | 0.047 | 0.031 | 0.038 | 0.029 | 0.058 |
| P | 0.006 | 0.0065 | 0.007 | 0.009 | 0.078 |
| S | 0.010 | 0.0056 | 0.01 | 0.008 | 0.0076 |
| Cu | 0.020 | 0.025 | 0.012 | 0.017 | 0.029 |
| Ni | 0.019 | 0.022 | 0.019 | 0.016 | 0.023 |
| Ti | 0.001 | 0.001 | 0.001 | 0.001 | 0.002 |
| Mo | 0.002 | 0.003 | 0.008 | 0.002 | 0.002 |

The balance of the composition of heats 1 to 5 consists, of course, of iron and possibly impurities resulting from the smelting.

Measurement of the Increase in Yield Strength after Baking

To quantify the possible increase in yield strength of the steel after baking, conventional tests were carried out that simulate the actual use during which a sheet is drawn and then baked.

A test piece is therefore subjected to a uniaxial tensile strain of 2% and then undergoes a heat treatment for 170° C. for 20 minutes.

During this process, the following are measured in succession:

- the yield strength $R_{e0}$ of the test piece cut from the steel sheet that has undergone continuous annealing; then
- the yield strength $R_{e2\%}$ of the test piece that has undergone uniaxial tensile strain of 2%; and then
- the yield strength $R_{eHT}$ after 170° C. heat treatment for 20 minutes.

The difference between $R_{e0}$ and $R_{e2\%}$ is used to calculate the work hardening WH, whereas the difference between $R_{e2\%}$ and $R_{eHT}$ gives the bake hardening denoted, for this conventional test, by BH2.

Abbreviations Employed

A: elongation at break in %

$R_e$: yield strength in MPa $R_m$: tensile strength in MPa n: work hardening coefficient P: yield plateau in %

EXAMPLE 1

Slabs were manufactured from heats 1 to 4, the slabs then being hot rolled at a temperature above Ar3. For these heats, the end-of-rolling temperature was between 854 and 880° C. The sheets thus obtained were coiled at a coiling temperature between 580 and 620° C. for these heats, and then they were cold rolled with a reduction ratio varying from 70 to 76%.

The sheets were then subjected to a continuous annealing operation having the following steps:

- reheating of the sheet until a temperature of 750° C. was reached, at a reheating rate of 6° C./s; then
- a soak at this temperature for 50 seconds;
- slow cooling down to 650° C., at a cooling rate of 4° C./s; then rapid cooling down to 400° C., at a cooling rate of 28° C./s;

a soak at this temperature for 170 seconds; and then cooling down to the ambient temperature, at a cooling rate of 5° C./s.

Next, test pieces were cut from these sheets and their yield strengths $R_{e0}$ measured. Next, these test pieces were subjected to a uniaxial tensile strain of 2% and their yield strength $R_{e2\%}$ and their other mechanical properties were measured. Next, they were subjected to a conventional heat treatment at 170° C. for 20 minutes and their new yield strengths $R_{eHT}$ were measured. Their BH2 values were then calculated.

The results obtained are given in the table below:

| Test piece | $R_e$ (MPa) | $R_m$ (MPa) | P (%) | BH2 (MPa) |
|---|---|---|---|---|
| Heat 1 | 296 | 384 | 0 | 67 |
| Heat 2 | 305 | 422 | 0 | 44 |
| Heat 3 | 284 | 379 | 0.2 | 64 |

This shows that heats 1 to 3 according to the invention had good mechanical properties and a good BH2 value, and exhibited little or no yield plateau.

New test pieces were then cut from the sheets that had undergone continuous annealing, and these were subjected to a heat treatment at 75° C. for 10 hours. This heat treatment is equivalent to natural aging of 6 months at room temperature. The following results were obtained:

| Test piece | $R_e$ (MPa) | $R_m$ (MPa) | n | P % | A % |
|---|---|---|---|---|---|
| Heat 1 (fresh state) | 296 | 384 | 0.208 | 0 | 36.6 |
| Heat 1 (aged state) | 290 | 394 | 0.165 | 0.1 | 31.1 |
| Heat 2 (fresh state) | 305 | 422 | 0.189 | 0 | 33.1 |
| Heat 2 (aged state) | 299 | 431 | 0.160 | 0 | 31.0 |
| Heat 3 (fresh state) | 284 | 379 | 0.194 | 0.2 | 35.3 |
| Heat 3 (aged state) | 286 | 393 | 0.157 | 0.2 | 30.4 |

This shows that, after simulating 6 months of natural aging, heats 1 to 3 according to the invention do not exhibit a plateau extension unacceptable to the Z appearance (this being less than or equal to 0.2%).

EXAMPLE 2

Slabs were manufactured from heats 1 to 5 and then hot rolled, the end-of-rolling temperature being 850/880° C. The sheets thus obtained were coiled at a coiling temperature of 580/620° C. and then cold rolled with a reduction ratio varying from 70-76% for these heats.

The sheets were then subjected to a continuous annealing operation having the following steps:

reheating of the sheet until a temperature of 820° C. was reached, at a reheating rate of 7° C./s; then a soak at this temperature for 30 seconds;

slow cooling down to 650° C., at a cooling rate of 6° C./s; then rapid cooling down to 470° C., at a cooling rate of 45° C./s;

a soak at this temperature for 20 seconds; and then cooling down to ambient temperature, at a cooling rate of 11° C./s.

Next, test pieces were cut from these sheets and their yield strengths $R_{e0}$ measured. Next, these test pieces were subjected to a uniaxial tensile strain of 2% and their yield strengths $R_{e2\%}$ and their other mechanical properties were measured. Next, they were subjected to a conventional heat treatment at 170° C. for 20 minutes and their new yield strengths $R_{eHT}$ were measured. Their BH2 values were then calculated.

The results obtained are given in the table below:

| Test piece | $R_e$ (MPa) | $R_m$ (MPa) | P (%) | BH2 (MPa) |
|---|---|---|---|---|
| Heat 1 | 290 | 389 | 0 | 74 |
| Heat 2 | 315 | 424 | 0 | 64 |
| Heat 3 | 282 | 377 | 0 | 82 |
| Heat 4 | 310 | 413 | 0.2 | 59 |
| Heat 5 | 333 | 436 | 1.2 | 40 |

This shows that heats 1 to 4 according to the invention have good mechanical properties and a very good BH2 value, and exhibit little or no yield plateau, unlike heat 5 which has a 1.2% plateau.

New test pieces were then cut from the sheets that had undergone the continuous annealing, and these were subjected to a heat treatment at 75° C. for 10 hours. This heat treatment is equivalent to natural aging of 6 months at room temperature. The following results were obtained:

| Test piece | $R_e$ (MPa) | $R_m$ (MPa) | n | P % | A % |
|---|---|---|---|---|---|
| Heat 1 (fresh state) | 290 | 389 | 0.197 | 0 | 32.6 |
| Heat 1 (aged state) | 294 | 412 | 0.160 | 0.2 | 27.4 |
| Heat 2 (fresh state) | 315 | 424 | 0.180 | 0 | 32.8 |
| Heat 2 (aged state) | 325 | 447 | 0.147 | 0 | 27.3 |
| Heat 3 (fresh state) | 282 | 377 | 0.185 | 0 | 20.4 |
| Heat 3 (aged state) | 295 | 415 | 0.148 | 0 | 26.2 |
| Heat 4 (fresh state) | 310 | 413 | 0.187 | 0.2 | 31.7 |
| Heat 4 (aged state) | 311 | 425 | 0.163 | 0.1 | 29.5 |
| Heat 5 (fresh state) | 333 | 436 | 0.186 | 1.2 | 31.6 |
| Heat 5 (aged state) | 335 | 446 | 0.167 | 1.8 | 29.4 |

This shows that, after simulating 6 months of natural aging, heats 1 to 4 according to the invention do not exhibit a plateau unacceptable to the Z appearance (less than or equal to 0.2%), unlike heat 5 which has a plateau of 1.8%.

The invention claimed is:

1. A process for manufacturing bake hardening steel sheet comprising:

the smelting of a steel, the composition of which comprises, expressed in % by weight:

$0.03 \leqq C \leqq 0.06$ $0.50 \leqq Mn \leqq 1.10$ $0.08 \leqq Si \leqq 0.20$ $0.015 \leqq Al \leqq 0.070$ $N \leqq 0.007$ $Ni \leqq 0.040$ $Cu \leqq 0.040$ $P \leqq 0.035$ S≦0.015
Mo≦0.010
Ti≦0.005 it being understood that the steel also contains boron in an amount such that:

$$0.64 \leq \frac{B}{N} \leq 1.60$$

the balance of the composition consisting of iron and impurities resulting from the smelting;

the casting of a slab of this steel, this slab then being hot rolled in order to obtain a sheet, the end-of-rolling temperature being above that of the Ar3 point;

the coiling of said sheet at a temperature of between 500 and 700° C.; then the cold rolling of said sheet with a reduction ratio of 50 to 80%;

a continuous annealing heat treatment which is carried out for a time of less than 15 minutes; and a skin pass which is carried out with a reduction ratio of between 1.2 and 2.5%, wherein the continuous annealing heat treatment comprises a reheat of the steel until it reaches a temperature of between 750 and 850° C., isothermal soak followed by a first cooling operation comprising a stow first part carried out at a rate of less than 10° C./s, followed by a rapid second cooling operation carried out at a rate of between 20 and 50° C./s.

2. The process as claimed in claim 1, wherein said continuous annealing heat treatment comprises:

the first cooling operation down to a temperature between 380 and 500° C.; and an isothermal soak; and then the second cooling operation down to the ambient temperature.

3. The process as claimed in claim 1 or 2, wherein, in addition, the manganese content and the silicon content of the steel are such that:

$$4 \leq \frac{\%\ \mathrm{Mn}}{\%\ \mathrm{Si}} \leq 15.$$

4. The process as claimed in claims 1 or 2, wherein, in addition, the manganese content of the steel is between 0.55 and 0.65% by weight and the silicon content of the steel is between 0.08 and 0.12% by weight.

5. The process as claimed in claims 1 or 2, wherein, in addition, the manganese content of the steel is between 0.95 and 1.05% by weight and the silicon content of the steel is between 0.16 and 0.20% by weight.

6. The process as claimed in claims 1 or 2, wherein, in addition, the nitrogen content of the steel is less than 0.005% by weight.

7. The process as claimed in claims 1 or 2, wherein, in addition, the phosphorus content of the steel is less than 0.015% by weight.

8. A bake hardening sheet obtained by the process as claimed in claim 1 or 2, wherein the sheet has a composition comprising, expressed in % by weight:

0.03≦C≦0.06
0.50≦Mn≦1.20
0.08≦Si≦0.20
0.015≦Al≦0.070
N≦0.007
Ni≦0.040
Cu≦0.040
P≦0.035
S≦0.015
Mo≦0.010
Ti≦0.005 it being understood that the steel also contains boron in an amount such that:

$$0.64 \leq \frac{B}{N} \leq 1.60$$

the balance of the composition consisting of iron and impurities and has a yield strength of between 260 and 360 MPa, a tensile strength of between 320 and 460 MPa, a BH2 value of greater than 60 MPa and a yield plateau of less than or equal to 0.2%.

9. A part that can be obtained by cutting a blank from a hardening sheet as claimed in claim 8, said blank then being painted and baked at less than 200° C.

* * * * *